US007736241B2

(12) United States Patent
Lancia

(10) Patent No.: US 7,736,241 B2
(45) Date of Patent: Jun. 15, 2010

(54) MINIATURE GOLF HOLE SYSTEM

(76) Inventor: Steven A. Lancia, 20 Moshassuck Rd., Lincoln, RI (US) 02865

( * ) Notice: Subject to any disclaimer, the term of this patent is extended or adjusted under 35 U.S.C. 154(b) by 39 days.

(21) Appl. No.: 12/018,404

(22) Filed: Jan. 23, 2008

(65) Prior Publication Data

US 2009/0186716 A1 Jul. 23, 2009

(51) Int. Cl.
*A63B 69/36* (2006.01)

(52) U.S. Cl. ..... 473/171; 428/17

(58) Field of Classification Search ..... 473/157–164, 473/171; 428/17, 85–97, 317.5
See application file for complete search history.

(56) References Cited

U.S. PATENT DOCUMENTS

| | | | | | |
|---|---|---|---|---|---|
| 1,967,904 | A | | 7/1934 | Roberts | |
| 2,176,622 | A | | 10/1939 | Davis | |
| 2,515,847 | A | | 7/1950 | Winkler | |
| 3,418,897 | A | | 12/1968 | Humalainen | |
| 3,446,122 | A | | 5/1969 | Raichle et al. | |
| 3,661,687 | A | * | 5/1972 | Spinney et al. | 428/17 |
| 3,735,988 | A | * | 5/1973 | Palmer et al. | 473/162 |
| 3,801,421 | A | * | 4/1974 | Allen et al. | 428/17 |
| 3,995,079 | A | | 11/1976 | Haas, Jr. | |
| 4,268,551 | A | * | 5/1981 | Moore, Jr. | 428/17 |
| 4,556,213 | A | * | 12/1985 | Sharma | 472/92 |
| 4,875,682 | A | | 10/1989 | Paolillo | |
| 4,948,116 | A | * | 8/1990 | Vaux | 472/92 |
| 4,966,370 | A | | 10/1990 | Morris | |
| 4,988,106 | A | | 1/1991 | Coonrod | |
| 5,026,580 | A | * | 6/1991 | Hammon | 428/17 |
| 5,205,562 | A | * | 4/1993 | Hammon | 473/278 |
| 5,352,158 | A | * | 10/1994 | Brodeur, Jr. | 472/92 |
| 5,366,224 | A | | 11/1994 | Stanwyck et al. | |
| 5,419,561 | A | | 5/1995 | Weber | |
| 5,655,971 | A | | 8/1997 | Wayne | |
| 5,916,034 | A | | 6/1999 | Lancia | |
| 6,156,396 | A | * | 12/2000 | Florian | 428/17 |
| 6,221,445 | B1 | * | 4/2001 | Jones | 428/17 |
| 6,299,959 | B1 | * | 10/2001 | Squires et al. | 428/87 |
| 6,616,542 | B1 | * | 9/2003 | Reddick | 473/171 |
| 6,764,411 | B2 | * | 7/2004 | Knox | 473/162 |
| 7,155,796 | B2 | * | 1/2007 | Cook | 29/428 |
| 7,279,212 | B2 | * | 10/2007 | Foxon | 428/95 |
| 2002/0169027 | A1 | * | 11/2002 | Fowler | 473/157 |
| 2004/0086664 | A1 | * | 5/2004 | Seaton | 428/17 |
| 2008/0090672 | A1 | * | 4/2008 | Sells | 473/160 |
| 2009/0162579 | A1 | * | 6/2009 | McDuff | 428/17 |
| 2009/0172970 | A1 | * | 7/2009 | Prieto et al. | 36/71 |

* cited by examiner

*Primary Examiner*—Mark S Graham
(74) *Attorney, Agent, or Firm*—Salter & Michaelson

(57) ABSTRACT

A miniature golf hole system includes an expanded polystyrene foam base having a downwardly facing surface which is received on a supporting surface, and an upwardly facing surface having a predetermined surface contour; a laminated layer disposed over said expanded polystyrene foam base layer and having a generally uniform thickness which conforms to the predetermined surface contour of said base layer; and a turf-like surface layer applied to an upwardly facing surface of said laminated layer, said surface layer providing a smooth upwardly facing putting surface upon which a golf ball can be putted.

20 Claims, 7 Drawing Sheets

MINIATURE GOLF HOLE SYSTEM

TECHNICAL FIELD

The present invention relates in general to miniature golf hole courses, and pertains more particularly to an improved multiple layer miniature golf hole construction system having improved heat and weather resistance characteristics, as well as improved drainage characteristics.

BACKGROUND OF THE INVENTION

Traditionally, miniature golf hole courses have been constructed from a cement foundation base having outdoor carpeting attached to the top surface of the cement. There are a number of disadvantages associated with these traditionally constructed miniature golf hole courses. First of all, considering that miniature golf is traditionally an outdoor game, flooding of the course holes is commonplace during and after inclement weather. More specifically, rain causes the course to become unplayable not only during the inclement weather, but also for a time period following such inclement weather due to the poor drainage and slow drying characteristics associated with these conventionally constructed miniature golf hole courses. Secondly, such foul weather eventually causes the outdoor carpeting to become delaminated from the cement foundation, resulting in ripples and untrue play on the putting green surface. Also, there is cracking of the cement foundation due to freeze and thaw conditions, frost heaves, etc. Specifically, the porous nature of the concrete absorbs water later resulting in cracks and time-consuming and expensive maintenance of the golf hole system.

Miniature golf is a game which is well known and enjoyed by children and adults alike. U.S. Pat. No. 3,446,122 issued to L. Raichle et al. and U.S. Pat. No. 1,967,904 issued to Roberts both disclose typical prior art multi-layered constructions. Raichle et al. discloses a multi-layer construction particularly suitable for tennis courts, whereas Roberts shows a rubber surface material. However, neither of these references disclose a miniature golf hole construction system, such as the one contemplated by the instant invention.

A further prior art miniature golf hole system is shown in my earlier U.S. Pat. No. 5,916,034 which is hereby incorporated by reference herein in its entirety. This patent describes a construction system that employs improved drainage characteristics due to the relatively soft and porous nature of each layer of the structure. However, there was a tendency toward deterioration of the structure particularly over time.

Accordingly, it is an object of the present invention to provide a miniature golf hole system of multiple layer construction and that is characterized by improved longevity.

Another object of the present invention is to provide a miniature golf hole system that has improved drainage characteristics.

Still another object of the present invention is the provision of a miniature golf hole system that is modular in construction, lightweight, and easy to handle which allows for easier installation and removal.

A further object of the present invention is the provision of a miniature golf hole system that is heat and weather resistant and that does not deteriorate over time for a longer lasting and more accurate golf green surface.

Still a further object of the present invention is the provision of a miniature golf hole system that captures the attention of the golf player and is aesthetically pleasing in appearance.

Another object of the present invention is to provide a miniature golf hole system that is sturdy and is resistant to mold and rot.

Another object of the present invention is the prefabrication of the golf hole in grids in various sizes, with the undulations, designs and sizes pre-made in the factory, leaving the onsite construction minimum to just seaming of the grids, for rapid installation. Another object of the present invention is the application of this invention on the deck of cruise ships, because of their modular construction and light weight.

SUMMARY OF THE INVENTION

The multiple layer construction for the miniature golf hole system of the instant invention has improved durability and thus improved longevity. The final system product is characterized by high heat and weather resistance in a modular type construction in sections, pre-manufactured and designed to the layout. The grids after layout on the deck of the cruise ship are then seamed with a fiberglass mesh and resin to create a monolithic surface. Moreover, the system product enables the construction of complete miniature golf systems that are not subject to mold, rot or any other deterioration. The present miniature golf hole system is also characterized by improved water drainage, and is constructed to allow water to pass out the bottom or sides of the system, thus preventing puddles or water pockets from forming on the top surface of the outdoor carpeting. Further, additional detail structure may be more easily incorporated within the green surface, i.e., sand traps, for a more aesthetically pleasing and challenging miniature golf hole course.

The present invention is directed to a modular miniature golf hole system or product having a multiple layer construction and constructed and arranged to provide a system having improved durability and longevity. The system includes an expanded polystyrene foam base layer having a downwardly facing surface which is received on a supporting surface, and an upwardly facing surface having a predetermined surface contour; a laminated layer disposed over the expanded polystyrene foam base layer and having a generally uniform thickness which conforms to the predetermined surface contour of the base layer; and a turf-like surface layer applied to an upwardly facing surface of the laminated layer, said surface layer providing a smooth upwardly facing putting surface upon which a golf ball can be putted. The laminated layer includes a light-weight fibrous layer and a pair of stiff reinforced layers having the light-weight fibrous layer disposed therebetween.

In accordance with other aspects of the present invention the artificial golf putting surface may provide one of the stiff reinforced layers is comprised of a fiberglass mesh embedded in an epoxy resin material, and the other of the stiff reinforced layers is comprised of a fiberglass mesh embedded in a heat resistant vinyl ester resin material; the base layer includes at least one drainage channel which extends in a generally vertical orientation through at least the base layer from the upwardly facing surface of the base layer to the downwardly facing surface of the base layer; the surface layer comprises a woven carpet material; the surface layer further comprises a carpet pad under the woven carpet material; the carpet material is adhered to said laminated layer by means of an adhesive material; one of the stiff reinforced layers extends about the base layer to under the base layer; including a fiberglass channel drainage spacer under the base layer; and including a aluminum tube under the base layer used as a stiffener.

In accordance with still another embodiment of the present invention there is provided an artificial golf putting surface construction, comprising: an expanded polystyrene foam base layer having a downwardly facing surface which is received on a supporting surface, and an upwardly facing surface having a predetermined surface contour; a pair of layers on each top and bottom side of the base layer and each formed of a fiberglass mesh embedded in an epoxy laminating resin; and a turf-like surface layer disposed over an upwardly facing surface of the top layer of the pair, said surface layer providing a smooth upwardly facing putting surface upon which a golf ball can be putted.

In accordance with further aspects of the present invention the artificial golf putting surface may further include an anti microbial, anti fungal insulative balsa material between the top layer of a fiberglass mesh embedded in an epoxy laminating resin and the surface layer; a layer of a fiberglass mesh embedded in a heat resistant vinyl ester resin material and disposed between the balsa material and the surface layer; the surface layer comprises a woven carpet material; the surface layer further comprises a carpet pad under the woven carpet material; the carpet material is adhered to the laminated layer by means of an adhesive material.

In accordance with still another embodiment of the present invention there is provided an artificial golf putting surface construction, comprising: an expanded polystyrene foam base layer having a downwardly facing surface which is received on a supporting surface, and an upwardly facing surface having a predetermined surface contour; a plurality of additional layers disposed in sequence over said base layer and including the following layers; a layer of a fiberglass mesh embedded in an epoxy laminated resin material; an insulative layer of a balsa material; a layer of a fiberglass embedded in a heat resistant vinyl ester resin; and a turf-like surface layer applied to an upwardly facing surface of said laminated layer, said surface layer providing a smooth upwardly facing putting surface upon which a golf ball can be putted; and wherein said layer of a fiberglass mesh embedded in an epoxy laminated resin material extends about the base layer to under the base layer.

In accordance with a further aspect of the present invention the base layer includes at least one drainage channel which extends in a generally vertical orientation through at least the base layer from the upwardly facing surface of said base layer to the downwardly facing surface of said base layer, said drainage channel draining away water, a fiberglass channel drainage spacer under the base layer, and a aluminum tube under the base layer used as a stiffener.

DESCRIPTION OF THE DRAWINGS

Other objects, features and advantages of the invention shall become apparent as the description thereof proceeds when considered in connection with the accompanying illustrative drawings, in which.

Corresponding reference numbers designate corresponding parts throughout the drawings.

DETAILED DESCRIPTION

Figure 1:
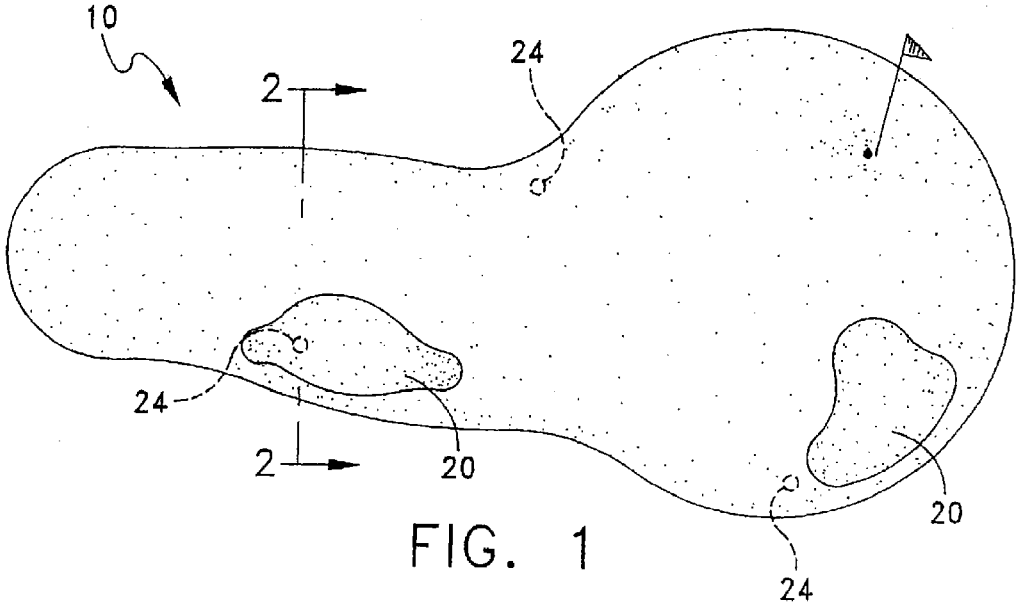
FIG. 1 is a top plan view of a golf hole of a miniature golf hole system of the present invention.

Referring now to the drawings, and more particularly to FIG. 1, a top plan view of a miniature golf hole system of the instant invention is shown and generally indicated at 10. The golf hole system 10 is especially effective in substantially preventing the buildup of water on the golf hole system. Since most such systems are used outdoors and are subject to the elements, it is important that the system be capable of draining water. For most conventional golf hole systems prior to the present invention, failure to prevent buildup of water can cause delamination of the system's components. The present invention is constructed to eliminate such buildup of water. Moreover, the system of the present invention is particularly constructed for longevity and to prevent any substantial damage over time such as the build-up of mold or rotting. It is also desired to provide for a longer lasting, aesthetically pleasing, and more accurate miniature golf and practice putting green surface.

It should be understood that the design and shape of the golf hole of the system 10 depicted in FIG. 1 will not always be the same, and that each individual golf hole of the miniature golf hole system will have a different layout that may be customized to include any number of desirable shapes or characteristics. As illustrated in FIG. 1, selectively designed and located undulations and sand traps 20 may be sculptured into the putting green surface to provide a more challenging putting hole which will capture and maintain the attention of the miniature golf player.

Figure 6:
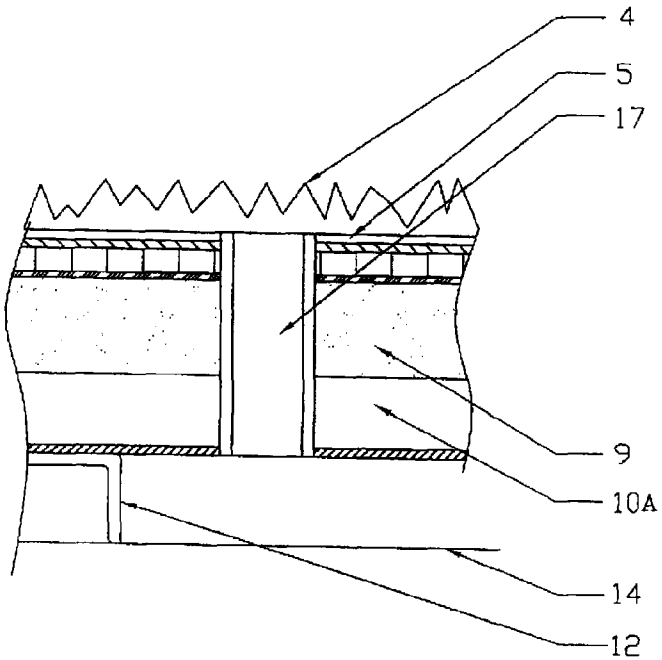
FIG. 6 is a fragmentary cross-sectional view of the miniature golf hole system of the present invention taken at a drainage location and FIG. 7 is a fragmentary perspective view of an alternate embodiment of the miniature golf hole system in accordance with the present invention.

FIG. 1 also shows a plurality of drainage channels 24 strategically located at each of the noticeably low areas and large flat areas of the components of the golf hole system 10 for allowing surface water captured in these areas to drain, and preventing the accumulation of undesirable rainwater and associated flooding of the golf hole system 10. As shown in FIG. 6, the drainage channel 17 is disposed at selected locations where accumulated water migrates so that any water that is captured in these selected low flat areas will be emptied into the drainage channels 17 and subsequently diverted out the bottom or sides of the golf hole system 10. The diameter of each channel 17 varies depending on the amount of wetness to be experienced by the system 10, i.e., the higher the rain fall, the larger the channel.

Figure 2:
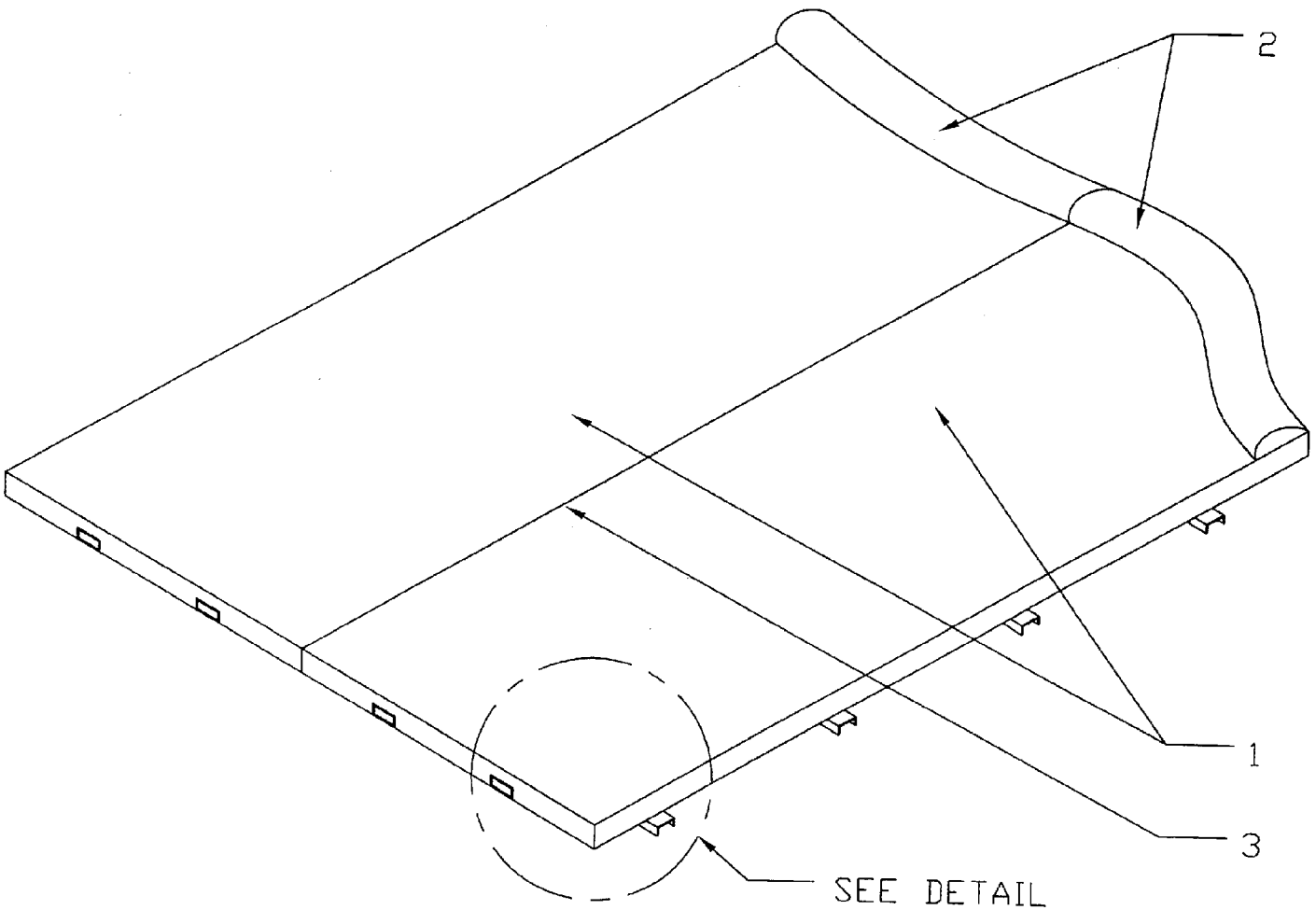
FIG. 2 is a perspective view of a section of the miniature golf hole system showing separate grids and an edge berm.

The system of the present invention is modular and is considered as constructed in multiple layers. FIG. 2 illustrates the system as comprised of interconnected grids 1 shown connected at a joint 3. Various techniques may be used for joining the grids at the joint 3. Each of the grids shown in FIG. 2 has a peripheral berm 2. There may be other grids that are not provided with any berm. FIG. 2 also shows the fiberglass channel drainage spacers 12 at the base of the system, as well as stiffeners 10.

The golf hole system 10 is modular in construction making it lightweight and easy to handle, and allowing for easier customer installation, without any further assistance from the factory. Each element of the present invention is widely used for a variety of different applications and thus are well known in the art. However, the combination and order of layering in the miniature golf hole system 10 of the instant invention is believed to represent a significant improvement in the art which has substantial commercial merit. The system of the present invention is particularly characterized by improved durability and longevity.

Figure 3:
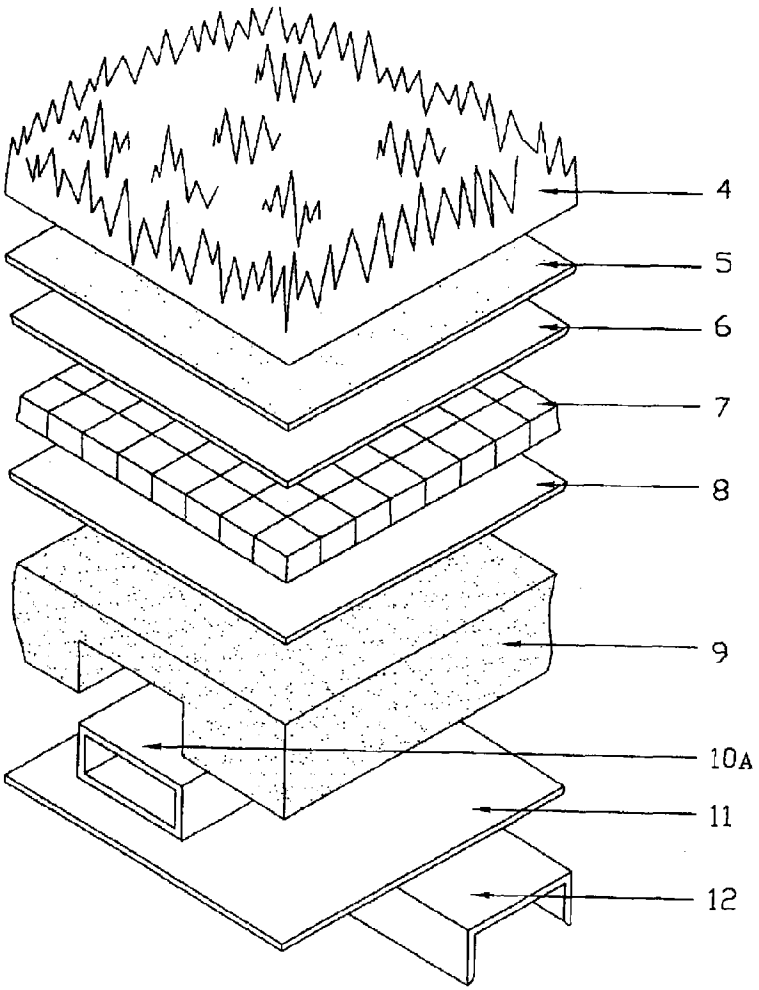
FIG. 3 is a perspective view of a portion of the miniature golf hole system illustrating its multiple layer construction.
Figure 4:
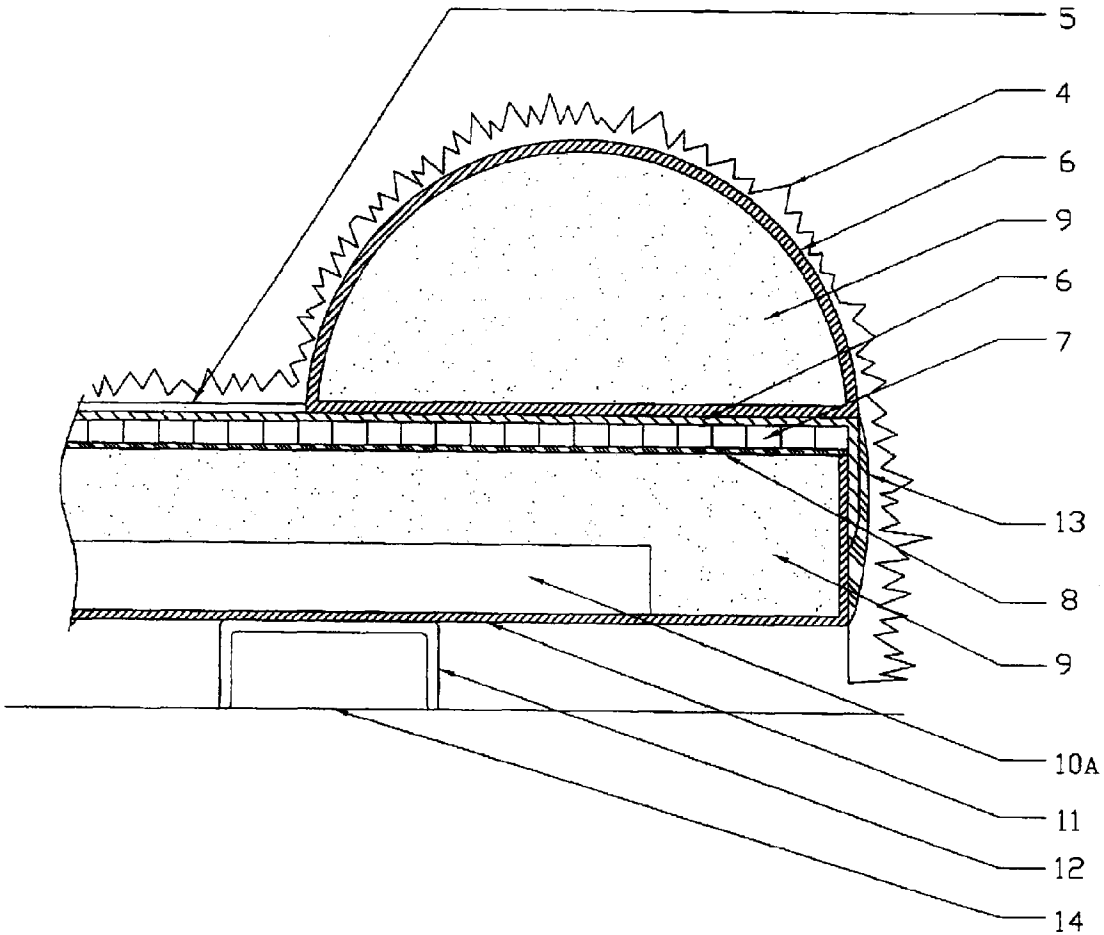
FIG. 4 is a cross-sectional view showing each layer of the miniature golf hole system of the present invention taken at the berm.

The multiple layers of the system of the present invention are shown in an exploded perspective view in FIG. 3. A cross-sectional view at the berm is shown in FIG. 4. The multiple layer construction comprises an expanded polystyrene (EPS) base 9, a laminated segment that includes layers 6-8 and an overlying turf layer. The turf layer is considered as including the artificial turf layer 4 and an insulative and durable carpet pad layer 5. The laminated segment includes layer 6 which preferably is constructed of a 40 oz fiberglass mesh embedded in a heat resistant vinyl ester resin; a layer 7 which preferably is constructed of an anti-microbial, anti-fungal, insulative balsa material; and a layer 8 which preferably is constructed of a 10 oz fiberglass mesh embedded in an epoxy laminating resin.

The system further includes a lower layer 11 which preferably is constructed of a 40 oz fiberglass mesh embedded in an epoxy laminating resin. Refer also to FIG. 4 which shows the layer 11 as disposed under and on the sides of the base layer 9. In a sense the layer 11 is contiguous with the layer 8, but the layer 11 is a 40 oz fiberglass mesh while the layer 8 is a 10 oz fiberglass mesh, both in an epoxy laminating resin.

Figure 5:
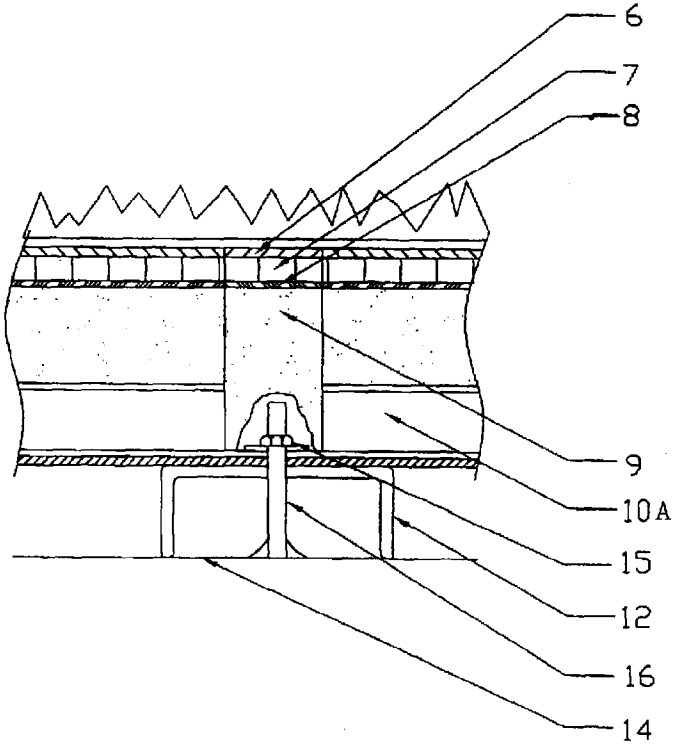
FIG. 5 is a fragmentary cross-sectional view of the miniature golf hole system of the present invention taken at an attachment location.

The system also includes a series of stiffener channels 10A shown in FIGS. 3-5 and accommodated in channels in the base layer 9 such as show in the perspective view of FIG. 2. These stiffener channels or tubes extend generally in parallel one to the next as shown in FIG. 2. Similar stiffener tubes may also be provided transverse to the illustrated tubes 10A. The tubes 10A are shown as rectangular and hollow. However, these tubes may also be of other shapes and sizes. It is preferred that the tubes 10A be inserted in an open channel in the base layer 9 as illustrated in FIG. 3. Below the layer 11 there is also provided a series of drainage members 12. These are preferably of U-shape as shown in FIGS. 3 and 4 and preferably are each a fiberglass channel drainage spacer.

The order of arrangement of the layers of the miniature golf hole system 10 is best illustrated in FIGS. 3-5. First, the BPS foam base 9 is prefabricated to customer specifications and has a density ranging from 0.5 to 4.0 lb./cu. ft. Next, the layers 8 and 11 are applied around the base layer 9. Adhesives may be used for that purpose. Next, the anti-microbial and anti-fungal fibrous layer 7 has the layers 6 and 8 disposed thereabout. The layer 7 is preferably constructed of a light-weight material such as a balsa wood. Next, the pad layer 5 is then applied to the upper exposed side of the 40 oz fiberglass mesh embedded in a heat resistant vinyl ester resin layer 6. The pad material may be constructed of a conventional carpet pad material that is of good quality. Last, the outdoor carpeting 4, which is fabricated from porous woven material having cut resin strands that mimic grass, as is known in the art, is applied over the carpet pad 5 and attached thereto with a standard carpet adhesive. The attachment between the outdoor carpeting 4 and the carpet pad 5 is very secure and unlikely to delaminate due to the bonding nature associated with the carpeting adhesive and the separate layers. Specifically, the carpet adhesive fills channels, which are a characteristic property of the carpet pad, and becomes locked therein for permanently attaching the carpeting to both the pad and the layers underneath.

As shown in FIGS. 3-5, a drainage system is further attached by suitable means beneath the EPS foam base 9 for better drainage in connection with areas that do not drain well or are subject to drainage on pitch, i.e., a ship or a buoyant dock where the water is unable to drain through the area substrate underneath the golf hole system, such as dirt, sand and ground associated with systems installed on land. The drainage system allows the water to drain through, in the direction of the pitch in the undersurface substrate, hence keeping an even flow of water to a proper drainage area. Preferably, the drainage construction is fabricated from the illustrated fiberglass channel drainage spacers 12 that are attached by appropriate means to the bottom of the system.

Refer now to FIG. 5 for a fragmentary cross-sectional view that illustrates the means of attaching the system to an existing metal deck 14. An attachment stud 16 is used secured to the decking and extending though the fiberglass channel drainage spacer 12 and though the layer 11 to the tube 10A. A nut and washer 15 is attached to the stud 16. See also FIG. 6 for a fragmentary cross-sectional view at one of the drainage tubes 17. The tube 17 extends from the turf layer 4 down to the space below the layer 11.

The miniature golf hole system 10 further includes a number of differently designed edge systems (not shown) which function to keep the golf ball in play as well as provide an aesthetically pleasing appearance. The edge systems may range from brick, rock, or any other material that provides a desirable looking finish to the miniature golf hole course.

Figure 7:
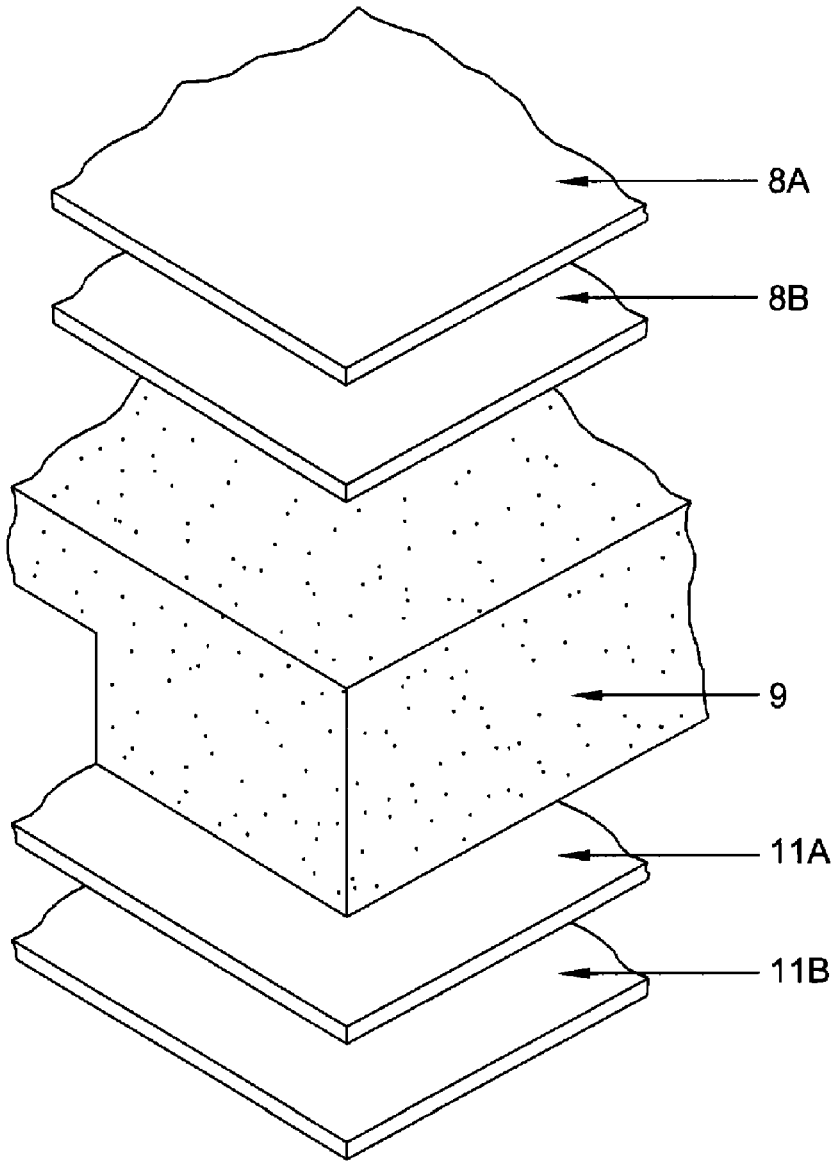

Refer to FIG. 7 for an alternate embodiment of the present invention in which there are a pair of layers 8A and 8B on the top side of the base layer 9 as well as a pair of layers 11A and 11B on the bottom side of the base layer 9.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An artificial golf putting surface construction, comprising:

an expanded polystyrene foam base layer having a downwardly facing surface which is received on a supporting surface, and an upwardly facing surface having a predetermined surface contour;

a laminated layer disposed over said expanded polystyrene foam base layer and having a generally uniform thickness which conforms to the predetermined surface contour of said base layer;

and a turf like surface layer applied to an upwardly facing surface of said laminated layer, said surface layer providing a smooth upwardly facing putting surface upon which a golf ball can be putted;

said laminated layer including a light-weight fibrous layer and a pair of stiff reinforced layers having the light-weight fibrous layer disposed therebetween.

2. The artificial golf putting surface of claim 1 wherein one of said stiff reinforced layers is comprised of a fiberglass mesh embedded in an epoxy resin material, and the other of said stiff reinforced layers is comprised of a fiberglass mesh embedded in a heal resistant vinyl ester resin material.

3. The artificial golf putting surface of claim 2 wherein said base layer includes at least one drainage channel which extends in a generally vertical orientation through at least the base layer from the upwardly facing surface of said base layer to the downwardly facing surface of said base layer, said drainage channel draining away water.

4. The artificial golf putting surface of claim 1 wherein said surface layer comprises a woven carpet material.

5. The artificial golf putting surface of claim 4 wherein said surface layer further comprises a carpet pad under the woven carpet material.

6. The artificial golf putting surface of claim 5 wherein said carpet material is adhered to said laminated layer by means of an adhesive material.

7. The artificial golf putting surface of claim 1 wherein said one of said stiff reinforced layers extends about said base layer to under said base layer.

8. The artificial golf putting surface of claim 1 including a fiberglass channel drainage spacer under said base layer.

9. The artificial golf putting surface of claim 1 including a aluminum tube under said base layer used as a stiffener.

10. An artificial golf putting surface construction, comprising:

an expanded polystyrene foam base layer having a downwardly facing surface which is received on a supporting surface, and an upwardly facing surface having a predetermined surface contour;

a pair of layers on each top and bottom side of said base layer and each formed of a fiberglass mesh embedded in an epoxy laminating resin;

and a turf-like surface layer disposed over an upwardly facing surface of the top layer of the pair, said surface layer providing a smooth upwardly facing putting surface upon which a golf ball can be putted.

11. The artificial golf putting surface of claim 10 further including an anti microbial, anti fungal insulative balsa material between the top layer of a fiberglass mesh embedded in an epoxy laminating resin and the surface layer.

12. The artificial golf putting surface of claim 11 further including a layer of a fiberglass mesh embedded in a heat resistant vinyl ester resin material and disposed between said balsa material and said surface layer.

13. The artificial golf putting surface of claim 11 wherein said surface layer comprises a woven carpet material.

14. The artificial golf putting surface of claim 13 wherein said surface layer further comprises a carpet pad under the woven carpet material.

15. The artificial golf putting surface of claim 14 wherein said carpet material is adhered to said surface layer by means of an adhesive material.

16. An artificial golf putting surface construction, comprising:

an expanded polystyrene foam base layer having a downwardly facing surface which is received on a supporting surface, and an upwardly facing surface having a predetermined surface contour;

a plurality of additional layers disposed in sequence over said base layer and including the following layers;

a layer of a fiberglass mesh embedded in an epoxy laminated resin material;

an insulative layer of a balsa material;

a layer of a fiberglass embedded in a heat resistant vinyl ester resin;

and a turf-like surface layer applied to an upwardly facing surface of said layer of a fiberglass embedded in a heat resistant vinyl ester resin, said surface layer providing a smooth upwardly facing putting surface upon which a golf ball can be putted;

wherein said layer of a fiberglass mesh embedded in an epoxy laminated resin material extends about said base layer to under said base layer.

17. The artificial golf putting surface of claim 16 wherein said surface layer comprises a woven carpet material.

18. The artificial golf putting surface of claim 17 wherein said surface layer further comprises a carpet pad under the woven carpet material.

19. The artificial golf putting surface of claim 18 wherein said carpet material is adhered to said laminated layer by means of an adhesive material.

20. The artificial golf puffing surface of claim 19 wherein said base layer includes at least one drainage channel which extends in a generally vertical orientation through at least the base layer from the upwardly facing surface of said base layer to the downwardly facing surface of said base layer, said drainage channel draining away water, a fiberglass channel drainage spacer under said base layer, and a aluminum tube under said base layer used as a stiffener.

* * * * *